US007699983B2

(12) United States Patent
Andrei

(10) Patent No.: US 7,699,983 B2
(45) Date of Patent: Apr. 20, 2010

(54) SWIMMING POOL SKIMMER COMPRISING TWO INDEPENDENT PIECES FIXED TO ONE ANOTHER ORIENTABLY

(75) Inventor: Gerard Andrei, Saint Cyr sur Mer (FR)

(73) Assignee: Gatech, Gemenos (FR)

( * ) Notice: Subject to any disclaimer, the term of this patent is extended or adjusted under 35 U.S.C. 154(b) by 0 days.

(21) Appl. No.: 12/331,676

(22) Filed: Dec. 10, 2008

(65) Prior Publication Data

US 2009/0159516 A1 Jun. 25, 2009

(30) Foreign Application Priority Data

Dec. 20, 2007 (FR) ..... 07 60061

(51) Int. Cl.
*E04H 4/12* (2006.01)

(52) U.S. Cl. ..... 210/167.1; 210/232; 210/416.2; 4/507

(58) Field of Classification Search ..... 210/167.1, 210/167.12, 232, 416.1, 416.2; 4/507
See application file for complete search history.

(56) References Cited

U.S. PATENT DOCUMENTS

| | | | | |
|---|---|---|---|---|
| 3,765,534 | A | 10/1973 | West et al | |
| 7,076,813 | B2 * | 7/2006 | Stetson | 4/508 |
| 2005/0235408 | A1 * | 10/2005 | Stetson | 4/508 |
| 2006/0042689 | A1 | 3/2006 | Hinojosa, Jr. | |

* cited by examiner

*Primary Examiner*—Fred Prince
(74) *Attorney, Agent, or Firm*—Lucas & Mercanti, LLP

(57) ABSTRACT

A swimming pool skimmer which has two independent pieces, a first piece and a second piece, fixed to one another orientably. The first piece forms a first guide tunnel for water in the swimming pool and has a first axis of symmetry in its longitudinal direction. The second piece has a body with a cylindrical wall and has a second axis of symmetry in its longitudinal direction. The first and second pieces are suitable for being fixed to one another in several possible angular positions in which the inclination, between the first and second axes at the level of the first and second pieces, varies from 90° to 90°+α max when the first axis, at the level of the first piece, has an inclination varying from the horizontal to an angle α max below the horizontal, the second axis being vertical.

18 Claims, 4 Drawing Sheets

SWIMMING POOL SKIMMER COMPRISING TWO INDEPENDENT PIECES FIXED TO ONE ANOTHER ORIENTABLY

BACKGROUND OF THE INVENTION

The present invention relates to a novel type of orientable skimmer, that is, a device from a water circulation plant of the pool of a swimming pool, cooperating with a side wall of the pool of the swimming pool to suction and channel water from the pool by skimming its surface, the water being channeled in a pipe circuit external to the pool of the swimming pool. This type of device is also known as a skimmer.

A skimmer comprises two parts per se, specifically:

1/—a tunnel having a substantially rectangular cross-section, whereof the longitudinal axis is substantially horizontal, passing through the wall of the swimming pool and terminating at the level of the wall, the side walls of the tunnel also being flared in the direction of the interior of the swimming pool to favour water flow from the interior of the swimming pool to the exterior of the swimming pool by way of this opening in the form of a funnel. The opening of the skimmer is designed to receive a current of water from the pool of the swimming pool to the water circulation circuit outside the pool. The funnel-shaped part and the tunnel part aim to create shrinkage in width of the latter to generate acceleration of the water rate passing through it in the direction of the skimmer body. The opening of the opening, at the level of the wall of the swimming pool, is regulated by a pivoting panel, the opening being made by pivoting of the panel (acting as anti-return valve) as a function of the suction current of the water via the skimmer, in known fashion, and 2/—a skimmer body whereof the longitudinal axis is placed substantially vertically, that is, perpendicularly to the axis of said tunnel, the body of the skimmer comprising a cylindrical wall substantially having a circular cross-section, with a lower orifice cooperating with a conduit of the water treatment device, especially in the direction of a water treatment device, such as a sand filter. The skimmer body is for taking up a basket in its lower part, that is, in a well located in the skimmer body, but below the ceiling surface of the tunnel opening.

The "skimmer" or "surface skimmer" keeps the water plane perfectly clean. Attached to the electropump group, the skimmers can absorb the entire installation rate, thus rapidly ridding the water plane of leaves, hair, hairs, insects and impurities deposited before they grow heavy and fall to the bottom of the pool. These skimmers are fitted with an easily accessible basket, allowing retention of these elements to avoid obstruction of the conduits and protect the electropump group. If possible, the skimmers are placed facing the prevailing wind and facing the discharge outlets so as to propel impurities towards the extraction and create a current over the entire surface of the pool. Provided with cache, screws, flanges and joints, the skimmers are equipped with an extension which avoid cutouts in the ledge.

Traditionally, there are two distinct sizes of skimmer with small and large opening, though in both cases the skimmer body is substantially of the same dimension.

In conventional terms, the approximate skimmer dimensions are the following:

- external opening rectangular of the opening terminating on the pool:
- large opening: width=400 mm, height=165 mm, and
- small opening: width=200 mm approximately, height=130 mm.

The skimmer body has a circular cross-section of around 200 mm in diameter at its base, corresponding substantially to the diameter of the filtration basket.

The distance between the plane of the aperture of the opening on the pool side and the axis of the skimmer body depends on the thickness of the wall of the swimming pool and other installation conditions of the swimming pool when it is being installed. This distance can vary from 30 to 45 cm.

Most often, the tunnel part of the skimmer itself comprises two parts, specifically:

- a flared part, that is, whereof the rectangular cross-section of the tunnel reduces from its opening terminating in the wall in the direction of the skimmer body, and
- a second part of substantially constant rectangular cross-section placed between the skimmer body and the part of the tunnel in a funnel shape.

This offset of the skimmer body is linked to the thickness of the wall but, also, of the peripheral ledge around the pool, to the extent where the upper part of the skimmer body is covered by a plate and cover which contact at the level of the surround enclosing the pool, beyond the peripheral ledge.

Accordingly, the most significant deposits on the surface of the water of the pool are swept in through the opening and collected in this filtration basket.

For the quantity of water swept along in the skimmer to be optimal, with respect to its function as skimmer at the surface of the water, in conventional terms the level of the water in the upper chamber of the skimmer body, above the filtration basket, must arrive at a level corresponding substantially to ⅔ to 8/10 of the height of the opening of the skimmer body corresponding to the opening of the tunnel on the skimmer side. And, in theory also, the level of water at the level of the opening, that is, at the level of the opening of the tunnel on the pool side, must be substantially ⅔ to 8/10 of its height relative to the floor of the tunnel.

In skimmers in current use the two parts of the skimmer, specifically and respectively the tunnel/opening, on the one hand, and on the other hand, the filtration basket receptacle body, are placed according to perpendicular axes.

A problem comes up for swimming pools whereof the wall of the pool, receiving the skimmer, is slightly inclined relative to the vertical. This is the case in particular for swimming pools in a shell shape made of stratified composite materials based on synthetic resin and fibres, especially polyester resin, for which an inclination must be provided, from 2 to 5 degrees relative to the vertical, of the side walls of the shell to allow the shell to be stripped. The result is that after the opening is placed at the level of the wall of the pool of the swimming pool, the skimmer body is not quite vertical, which impairs proper functioning of the skimmer, as will be explained hereinbelow. In fact, the upper chamber of the skimmer, above the filtration basket, can be entirely filled with water when the external opening of the opening is filled to 80% only, according to the standard criterion considered as optimal for proper functioning of the skimmer. Inversely, the external opening of the opening will be filled to less than 50% so that the upper chamber of the skimmer body is filled from 50 to 80%. These two cases in point impair proper functioning of the water circulation and skimming of the water surface of the pool by the skimmer.

Another disadvantage of the inclination of the skimmer body is that a lifting device has to be applied to it to recover an upper end plane for cooperating with horizontal plates and covers at ground level. This hoist is generally constituted by a cross-section of a tubular washer of cylindrical wall with transverse cross-section inclined at its upper end, allowing its inclination to be adapted by rotation on itself to regain a horizontal plane at ground level.

Another problem of skimmers is their relative fragility, in particular at the level of the junction zone of the tunnel/opening part with the cylindrical body part of the skimmer. Therefore, at the worksite, when the swimming pool is being installed it is required to install the skimmer on the wall of the swimming pool and the skimmer body constitutes a nuisance due to its bulk outside the pool and often receives shocks on site.

Also, in winter, in the case of frost there is often waste, especially fissures at the level of the junction between the tunnel part and the cylindrical body of the skimmer.

In case the skimmer is damaged it is difficult to replace it, especially to remove the tunnel/opening part from the wall of the swimming pool. This is why most frequently local repairs are made, but which do not always prove reliable or satisfactory.

The aim of the present invention is to provide a novel type of skimmer which brings a solution to the abovementioned problems.

SUMMARY OF THE INVENTION

The present invention relates to a swimming pool skimmer comprising two independent pieces fixed to one another orientably, comprising:

a first piece forming a first guide tunnel for the water in the swimming pool from a first longitudinal end opening terminating in a side wall of the swimming pool to a second longitudinal end opening terminating on a second piece above of said filtration basket receptacle, said first piece having a first axis of symmetry in its longitudinal direction, and said second piece comprising a body with cylindrical wall forming a lower filtration basket receptacle basket of a first lateral orifice of said cylindrical wall communicating with said second opening of the first tunnel, and said cylindrical wall having a second axis of symmetry in its longitudinal direction, and the two first and second pieces being fixed to one another, orientably in several possible angular positions in which the inclination, between said first and second axes at the level of said first and second pieces, can vary from 90° to 90° +α max when said first axis, at the level of said first piece, has an inclination α relative to the horizontal varying from zero to an angle α max below the horizontal, said second axis being vertical.

It is understood that said second piece extends below said first piece such that the angle [90 +α], which can vary from 90° to [90 +α max], is measured in the positive direction of rotation from said second axis, at the level of said cylindrical wall, to said first axis, at the level of said first piece, that is, from the part of the second axis located below the first axis, to the first axe.

Therefore, this orientation enables said first axis to be substantially horizontal or slightly inclined by an angle α less than or equal to α max relative to the horizontal, while said second axis extends in a substantially vertical direction.

In practice, to place the skimmer on a swimming pool wall inclined by an angle α given relative to the vertical, said second axis is arranged according to a substantially vertical position and said first piece is arranged with said first axis according to a fixed inclined position relative to the horizontal by an angle α less than or equal to α max, especially so that said first piece is substantially perpendicular relative to the wall of the swimming pool when it is inclined by an angle α less than or equal to α max relative to the vertical, specifically slightly flared to the top in forming an angle of 90° +α with the bottom wall or the horizontal ground.

It is understood that said second opening of the first tunnel terminates in the second piece above said basket receptacle.

In practice, said angle α max less than or equal to 5° is sufficient, but a possibility of rotation by an angle α max less than or equal to 10° will preferably be provided.

Advantageously, said first piece comprises a first contact surface to cooperate with a second contact surface of complementary form of said second piece, said complementary forms of said contact surfaces of complementary form enabling circular rotation about the same axis of rotation perpendicular to said first and second axes of two said first and second pieces relative to one another by displacement, preferably by sliding one relative to the other of said first and second contact surfaces of complementary forms.

Complementary form of said first and second rims is understood to mean that if said first rim is concave in shape, said second rim is convex in shape, and vice versa.

In accordance with additional advantageous characteristics:

said first piece forms said first tunnel with substantially rectangular transversal cross-section whereof the side walls are flared in coming together from said first opening of said first tunnel terminating in said side wall of the swimming pool, to said second opening of the first tunnel, said second opening of said first tunnel being edged by a first peripheral rim forming said first contact surface fitting in a cylindrical envelope surface, and said second piece comprises a substantially cylindrical wall preferably of circular cross-section forming:

a lower cylindrical chamber for receiving said basket immediately after a lower orifice for communicating with the bottom of said lower chamber with a water discharge pipe in a water circulation circuit outside the swimming pool, especially in the direction of a water treatment device such as a sand filter, and a cylindrical upper chamber above the lower chamber, the cylindrical wall of the upper chamber having said first lateral orifice located above the receptacle zone of the basket, said first lateral orifice extending on the one hand forming a second tunnel extending in the direction of a third axis perpendicular to said second axis, a second end opening of said second tunnel being edged by a second peripheral rim forming said second contact surface fitting in a cylindrical envelope surface of the same circular radius of curvature as said first rim, and at least the side edges of the two first and second peripheral rims supporting at least partially against one another after fixing of said first and second pieces to one another in said angular position.

The flared, classic form of the side walls of the first tunnel of said first piece, still known as an opening, generates per se acceleration of the water current.

It is understood that:

said upper chamber does not have a bottom open to said first chamber and said first lateral orifice of the upper chamber is located above the receptacle zone of the basket when the latter is in position in the lower chamber, and said third axis corresponds to said first axis when said first and second pieces are fixed to one another with said first and second axes placed at 90°, and said first axis forms an angle α with said third axis when said first and second axes form an angle α+90°, said first lateral orifice of the upper chamber corresponds to a first longitudinal end opening of said second tunnel.

Complementary form of said rims is understood to mean that if the first rim is concave in shape the second rim is convex in shape, and vice versa.

The axis of rotation of said first and second piece, relative to one another, corresponds to the axis of said cylindrical envelope surface.

Said side walls of the first tunnel are substantially vertical when the skimmer is in position on the wall of the swimming pool.

The rectangular transversal cross-sections (that is, in planes perpendicular to said first and third axes) of said second openings of the first and second tunnels are substantially the same width, whereas said first opening of the first tunnel is wider than said second opening of the first tunnel.

More particularly, said second tunnel comprises at least one ceiling wall inclined relative to said third axis when the base wall of the second tunnel is parallel to said third axis and in continuation of the base wall of said first tunnel and when said first and third axes coincide such that said second opening of the second tunnel of rectangular cross-section is larger than said second opening of the first tunnel, and such that irrespective of the angular position in rotation relative to one another of said first and second contact surfaces formed by said first and second rims, said second opening of the first tunnel remains entirely included within the limits of said second corresponding opening of the second tunnel.

It is understood that the larger surface of said second opening of the second tunnel extends from a greater height (dimension in the vertical direction when the skimmer is in position on said side wall of the swimming pool).

Therefore, the water in acceleration in the first tunnel encounters no frontal obstacle when terminating in the second tunnel, irrespective of the axis of inclination less than or equal to $\alpha$ max of said first axis relative to the horizontal.

It is understood that:

in the maximal permissible angular position of said second piece relative to said first piece, the inclined bottom or base wall of said second tunnel is in continuation of the ceiling wall or, respectively, of the base wall of said first tunnel, and, optionally, in a substantially horizontal position, and the upper and lower edges of the first rim sufficiently project over the ceiling and respectively base walls at the level of said second opening of the first tunnel so that the upper and lower edges of said second rim always remain at least partially supported on said upper and lower edges of the first rim in the different possible angular positions. In other words, the upper and lower edges of the first rim (as well as the side edges) project by an arc of a circle of an angle $\alpha$ at least equal to $\alpha$ max relative to the ceiling and respectively base walls at the level of said second opening of the first tunnel.

According to other advantageous characteristics of the present invention:

said second rim comprises a plurality of perforations, said perforations being for receiving screws, and said first rim comprises a plurality of continuous and parallel fixing grooves extending in a direction in a plane perpendicular to said axis of rotation and parallel to said first axis, said fixing grooves being positioned vis-à-vis said perforations in all said possible angular positions, and said fixing grooves having width and depth suitable for wedging the ends of said screws once the latter are screwed through said perforations and said first and second pieces fixed to one another.

The large number of perforations on said side edges and said continuous fixing grooves, several possible angular positions, precisely adjust rotation relative to one another of said first and second pieces, for adapt to the inclination of the side wall of the swimming pool and regain the verticality of the cylindrical body of said second piece.

It is understood that said fixing grooves extend in a vertical plane when said skimmer is in position on a side wall of the swimming pool.

Even more particularly, said first and second rims comprise at least fixing grooves and, respectively, perforations on their said side edges, and preferably of said fixing grooves and perforations distributed evenly on their said side edges, upper edges and lower edges.

Advantageously still, at least one of said first and second peripheral rims, preferably said second rim, comprises a sealing groove over its entire circumference, near the edges of said second opening of the first or respectively second tunnel, said sealing groove being suitable to cooperate with a toric joint or suitable for receiving a bead of adhesive, preferably of elastomer type, more preferably of polyurethane or silicone type.

According to other particular characteristics:

said first tunnel comprises a first part with side walls, vertical and flared, to the side of said first end opening of the first tunnel, and a second part with side walls, parallel, vertical to the side of said second end opening of the first tunnel, and said second tunnel comprises side walls, parallel and vertical in the extension of the vertical side walls of said second part of said first tunnel.

It is understood that the vertical position of the walls of the first and second tunnels extends when the skimmer is in position on the side wall of the swimming pool.

The present invention also provides a swimming pool comprising at least one side wall equipped with at least one skimmer according to the invention.

Advantageously, a swimming pool according to the invention has a shell made of stratified composite materials based on synthetic resin and fibres, and said skimmer is applied to said side wall of said shell inclined by an angle $\alpha$ less than or equal to $\alpha$ max, said first axis being substantially perpendicular to said side wall of the swimming pool.

It is understood that said first axis is then inclined relative to the horizontal by a determined angle $\alpha$, less than or equal to $\alpha$ max.

In practice, $\alpha$ will be of the order of 2 to 3°, given the inclination of the side walls of shells stratified polyester of the swimming pool.

Said second axis is preferably positioned in a substantially vertical position.

In another embodiment said second axis is not substantially vertical and said upper chamber of said cylindrical body of the second piece is surmounted by a lifting device consisting of a tubular washer with cylindrical walls whereof the lower end, which is adjusted about the upper end opening of said upper chamber of the second piece, is straight according to a transversal cross-section, the upper end of said washer having a cross-section according to a non-straight angle relative to the axis of the cylindrical wall of said washer such that its said upper end is in a substantially horizontal plane when describing a rotation on itself of said washer about the axis of its cylindrical wall.

BRIEF DESCRIPTION OF THE DRAWINGS

Other characteristics and advantages of the present invention will emerge more clearly from the following description, given illustratively and non-limiting, in reference to the attached FIGS. 1 to 6 in which.

DETAILED DESCRIPTION OF THE DRAWINGS

Figure 1:
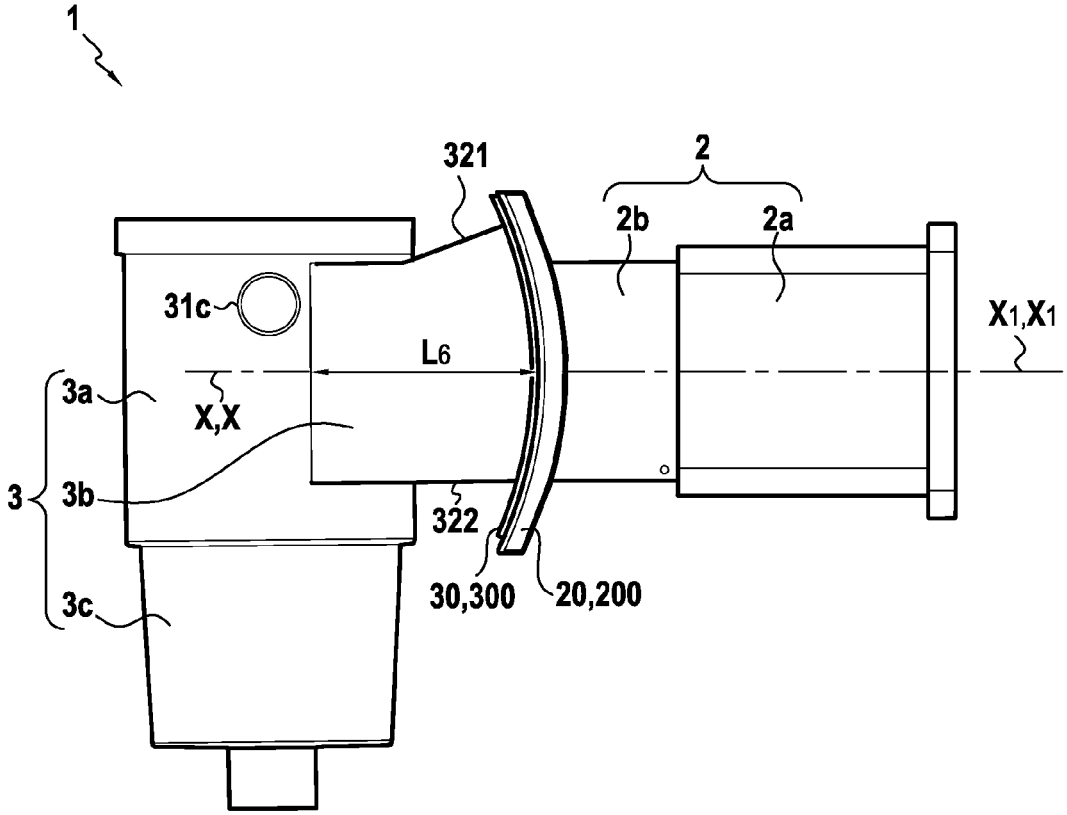
FIG. 1 illustrates a side view of an orientable skimmer according to the present invention.

In FIGS. 1 to 6, the skimmer is constituted by a first piece 2 or opening, forming two guide tunnels for the water of the swimming pool 2*a*, 2*b*, from a first opening 21 terminating in the side wall 5 of the swimming pool to a second opening 22 terminating on the second opening 32 of the second piece 3 to be described hereinbelow.

The first piece or opening 2 comprises a peripheral rim 21*a* about its said first opening 21, which peripheral rim 21*a* is applied to the inside of the side wall 5 of the swimming pool in which it terminates. The first piece 2 comprises a first part 2*a* forming a tunnel, whereof the upper 211*a* and lower 212*a* walls are horizontal and parallel, but the side walls 210*a* of which are placed vertically but in the form of a funnel, that is, coming together in the direction of a second part 2*b* of said first tunnel 2. In the second part 2*b*, the side walls 210*b* are parallel and vertical, whereas its upper 211*b* and lower 212*b* walls constituting, respectively, the ceiling and floor of said tunnel are parallel and substantially horizontal. The funnel-shaped tunnels of the first part 2*a* and straight section of the second part 2*b* have a transverse cross-section (that is, in a plane perpendicular to the axis X1X1) of said tunnel of substantially rectangular form.

At the end of said first tunnel 2, more precisely at the end of the part 2*b* of said first tunnel, said second opening 22 is enclosed by said first peripheral rim 200 formed by upper 202 and lower 203 edges and side edges 201. This said first peripheral rim 200 forms a first concave sliding contact surface 20, suitable for sliding on a second sliding contact surface of a second peripheral rim of said second piece, vis-à-vis, as will be described hereinbelow, this first contact surface 20 fitting in a cylindrical envelope surface having a radius of curvature R. The axis ZZ of said cylindrical envelope surface of the glide surface 20 is perpendicular to said same first axis X1X1 of said first part 2*a* and second part 2*b* of said first tunnel 2 and pass through the latter.

Figure 5:
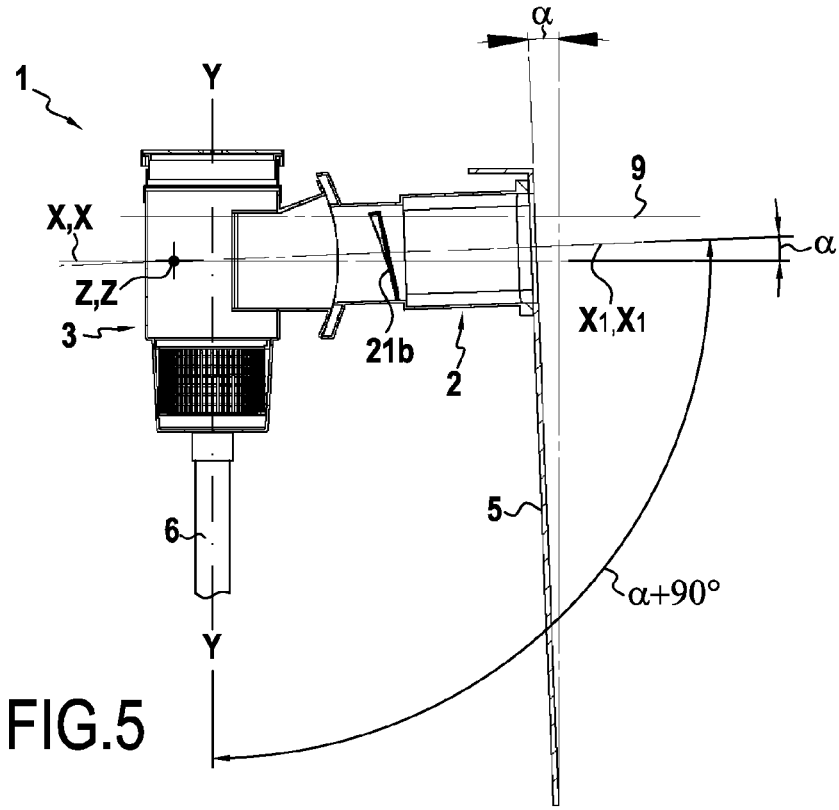
FIG. 5 illustrates an orientable skimmer, viewed in side elevation, adapted on a side wall of the swimming pool inclined relative to the vertical, said skimmer body being substantially vertical.

FIG. 5 shows the pivoting panel 21*b*, adapted to the floor of said second tunnel 2, at the junction zone between the first funnel-shaped part 2*a* and the rectilinear second part 2*b*. The first funnel-shaped part 2*a* generates acceleration of the water current sucked out through the opening 2, causing lowering of the pivoting panel 21*b*, letting the upper part of the water level and objects floating on it pass through, as FIG. 5 illustrates.

Figure 2:
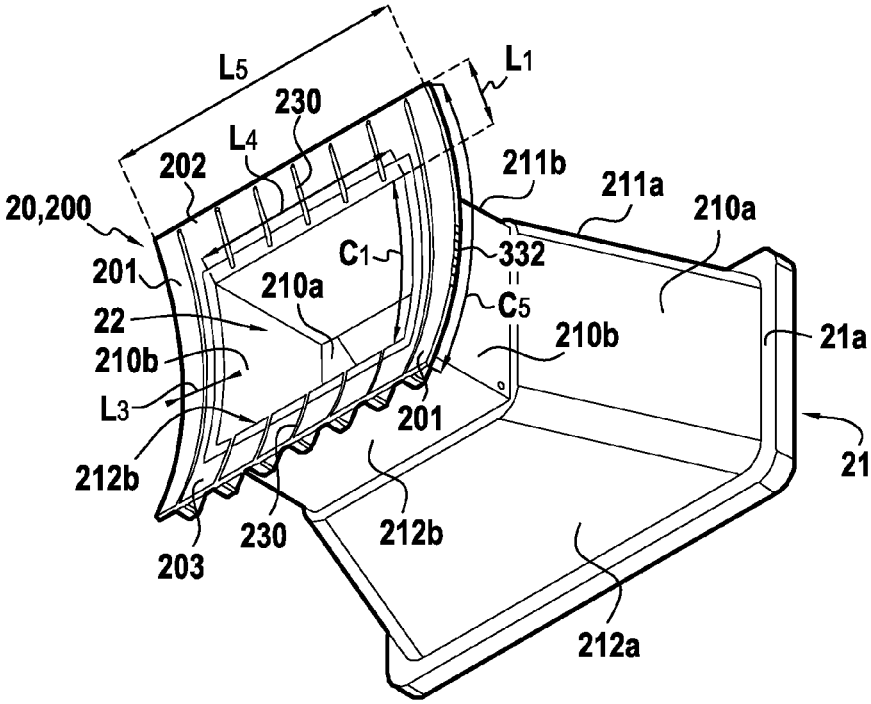
FIG. 2 illustrates said second piece, in perspective, of an orientable skimmer according to the present invention.

FIG. 2 illustrates a fixing groove 230 extending substantially over the whole arc of a circle traveled by said side edges 201 of the first peripheral rim 200 and five other fixing groove segments 230 placed parallel between the two grooves of the two side edges 201, respectively on the upper 202 and lower 203 edges of said first peripheral rim 200.

Figure 4:
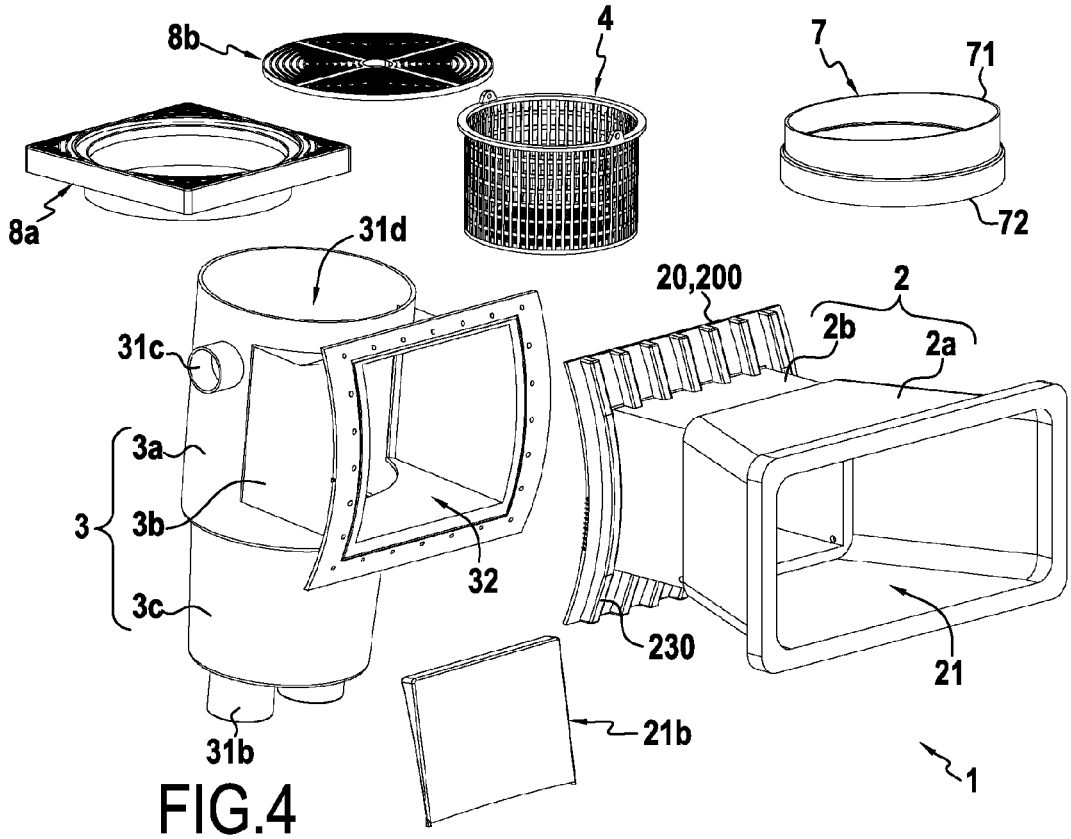
FIG. 4 illustrates said first and second pieces making up an orientable skimmer according to the present invention, in an exploded view, with different items equipping said skimmer.

FIG. 4 illustrates the second piece 3 constituted by a cylindrical body comprising an upper chamber 3*a* with cylindrical walls and of circular cross-section placed above a lower chamber 3*b* designed to receive a filtration basket 4, said lower chamber also having a cylindrical wall with a circular cross-section slightly lower than that of the upper chamber. The bottom of the lower chamber comprises a lower water evacuation orifice 31*b* in the direction of a conduit 6 of the water treatment device outside the swimming pool, especially in the direction of a water treatment device, such as a sand filter. The upper chamber 3*a* comprises an upper end opening 31*d*, open, via which said pre-filtration basket 4 can be inserted, which upper end of the upper chamber 3*a* is designed to be covered by a cover 8*a*, 8*b*, in general sealed on the ground adjoining the wall of the swimming pool. Excessive filling of the upper chamber of the skimmer body is avoided due to a side opening 31*c*, in its upper part, called "overflow", allowing excess water to be discharged.

As illustrated in FIG. 4, the second piece 3 also comprises a second tunnel 3*c* terminating in a first opening or first lateral orifice 31*a* of the cylindrical wall of the upper chamber 3*a*. The second end opening 32 of the second tunnel 3 terminates in said second end opening 22 of the first tunnel 2, when said first and second pieces are fixed to one another.

The second tunnel 3*c* comprises two side walls, parallel, vertical 320 and a lower base wall 322, substantially perpendicular to the second axis YY of said cylindrical walls of the upper 3*a* and lower 3*b* chambers of the cylindrical body of the second piece 3. The upper ceiling wall 321 of said second tunnel 3 is inclined upwards above the horizontal. This allows a second opening 32 of said second tunnel to be created, which is bigger than the second opening 22 of said first tunnel, whereas the first opening 31*a* of the second tunnel is substantially of the same size in height and width as the second opening 22 of the first tunnel.

Said second opening 32 of the second tunnel 3*c* is enclosed by a second peripheral rim 300, constituting the second contact sliding surface 30 of the second piece 3. The second peripheral rim 300 is a convex surface fitting in a cylindrical envelope surface of the same radius of curvature R as the cylindrical envelope surface of said first peripheral rim 200. The axis ZZ of the cylindrical envelope surface of the second peripheral rim 300 is perpendicular to said second axis YY of the cylindrical body, as well as to said third directional axis XX of the second tunnel 3*c*, the latter also being perpendicular to said second axis YY. The second tunnel 3*c* also has a substantially rectangular cross-section in transversal cross-section (that is, perpendicular to its said third directional axis XX).

It is understood that the axes of the cylindrical envelope surfaces of said first peripheral rims 200 and said second peripheral rims 300 coincide when said first and second pieces are fixed to one another.

Said radius of curvature R of said envelope surfaces is greater than the maximal length L6 of the side walls 320 of said second tunnel.

Figure 3:
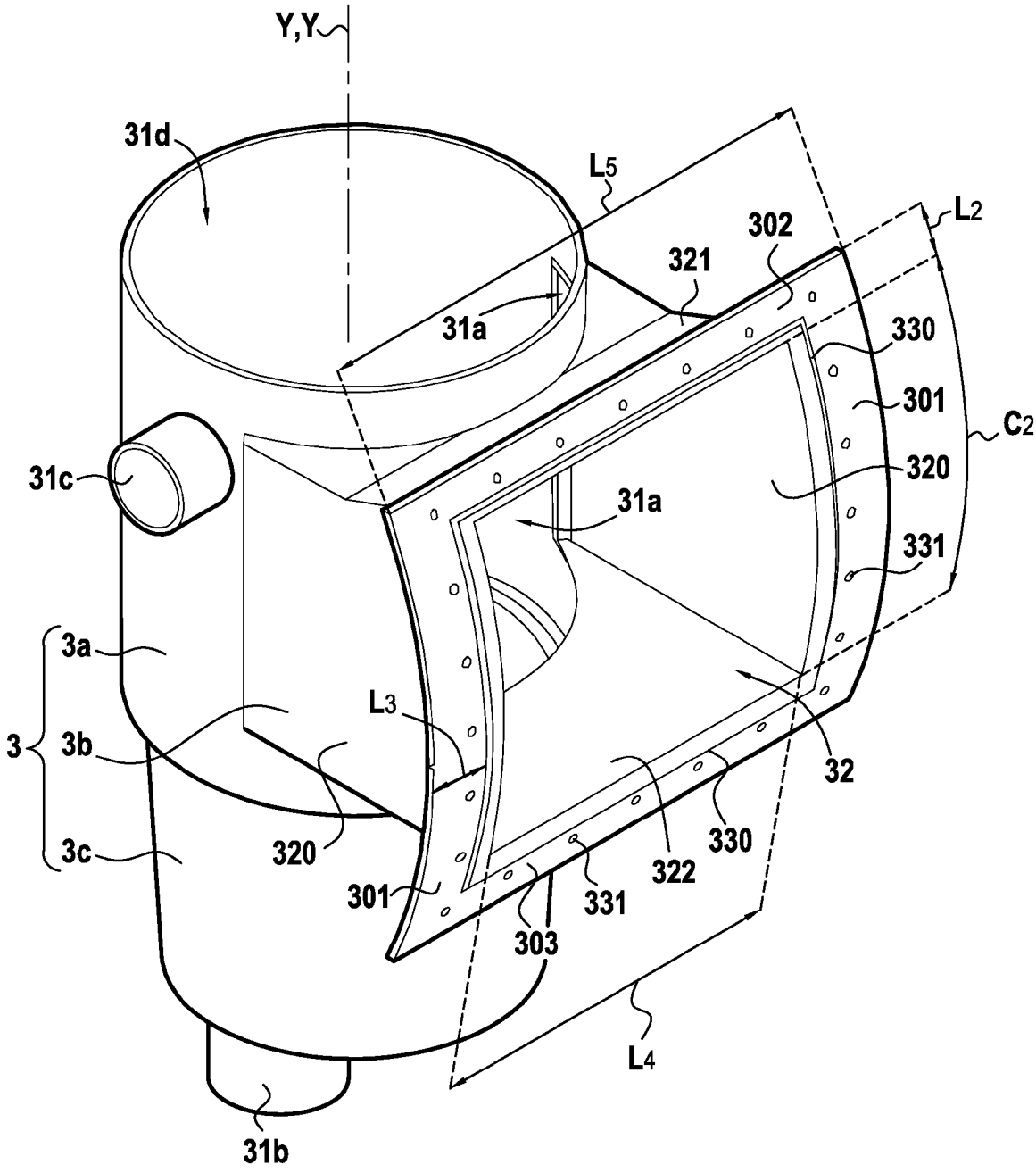
FIG. 3 illustrates said first skimmer piece according to the present invention, in perspective.

As illustrated in FIGS. 2 and 3, the side edges 301 of the second rim 300 and the upper 302 and lower 303 edges of the second rim 300 have the same lengths C5 and L5 as, respectively, the side edges 201 and upper 202 and lower 203 edges of said first rim 200. However, the upper 302 and lower 303 edges of the second rim 300 have a width L2 less than the width L1 of the upper 202 and lower 203 edges of the first rim 200. Also, said second opening 32 of the second rim 300 (idem hereinabove for 300) extends over an arc of a circle C2 greater than the arc of a circle C1 of said second opening 22 of the first rim 200. However, the widths L3 of the side edges 301 and 201 of the first rim 200 and second rim 300 are substantially identical, the same applying to the width L4 of said second opening 22 of the first tunnel 2 and second opening 32 of the second tunnel 3*c*.

The side edges 301, upper edge 302 and lower edge 303 of the second peripheral rim 300 comprise perforations 331, evenly spaced, which coincide with the grooves 230 when said first peripheral rim 200 and second peripheral rim 300 are adapted to one another, adjusted edge to edge, in alignment, such that the axes of rotation of the envelope surfaces of said first peripheral rim 200 and second peripheral rim 300 coincide in an axis of rotation ZZ passing through said second axis YY and perpendicular to the latter.

Said first piece 2 and second piece 3, at the level of their said first contact surface 20 and second contact surface 30 constituted by said first peripheral rim 200 and second peripheral rim 300, are fixed by means of screws 332 inserted from the outside of the swimming pool and behind the second peripheral rim 300 into said perforations 331, so as to sink in by force and be wedged, by screwing, in the depth of the grooves 230, the latter acting as pegs.

The greater arc of a circle C2 of the second opening of the second tunnel, relative to the arc of a circle C1 of the second opening of the first tunnel, on the one hand, and, the greater length of the arc of a circle L1 of the upper 202 and lower 203 edges of the first rim 200, relative to the length of the arc of a circle L2 of the upper 302 and lower 303 edges of the seconds rim 300, on the other hand, are determined so as to allow rotation by an angle α max, such that said second opening of the first tunnel still remains included within the limits of the second opening of the second tunnel, on the one hand, and such that, on the other hand, said second upper 302 and lower 303 edges of said second rim 300 still remain supported on the upper 202 and, respectively, lower 203 edges of the first peripheral rim 200, irrespective of the angular variation of said first axis relative to the horizontal by an angle α less than or equal to α max. Therefore, the water arriving via said second opening 22 of the first tunnel 2 encounters no obstacle as it passes through the second opening 32 of the second tunnel 3*c*, so as not to perturb suctioning of the water via the skimmer at the level of the junction zone of said first and second pieces.

The continuity of the fixing grooves 230 combined with the large number of perforations 331 extending on the side edges 301 of said second peripheral rim 300 precisely adjusts, in a large number of preferred angular positions, rotation of the two sliding surfaces 20 and 30 of said first and second pieces relative to one another, to adapt to an inclination of the side wall 5 of the swimming pool and regain the verticality of the cylindrical body 3*a*, 3*b*, of the second piece 3. The number of possible angular positions depends on the spacing of the perforations 331 on the side edges 301 of said second peripheral rim 300.

FIG. 4 illustrates a sealing groove 330 enclosing the second opening 32 of the second tunnel 3*c*, near the edges of said opening. This sealing groove 330 is designed to cooperate with an elastomer toric joint or to receive a bead of elastomer adhesive to ensure proper sealing of the fixing of said first and second pieces. It is understood that this joint and this bead of adhesive are applied prior to screwing in the screws 332 in the perforations 331 and grooves 230.

FIG. 1 illustrates an orientable skimmer 1 according to the present invention, whereof the opening upper 31*d* of the upper chamber 3*a* is surmounted by a lifting device 7, constituted by a washer having a wall of cylindrical cross-section whereof the lower end 72 is perpendicular to the axis of said cylindrical wall of the lifting device, whereas its upper end 71 is inclined, the variable height of the wall of the cylinder thus continuously increasing from a point of the circumference to the point diametrically opposite. Therefore, by rotation of said washer 7, the upper end 71 can adapt horizontally to a cover 8*a*, 8*b* placed horizontally on the surround enclosing the side wall 5 of the swimming pool, at ground level.

FIG. 5 illustrates an orientable skimmer 1 according to the present invention, adapted on a side wall 5 of polyester shell constituting a swimming pool, said side wall 5 being inclined by an angle α of 2.25° relative to the vertical. The inclination of an angle α+90 of the second axis YY of the cylindrical body of the second piece 3 relative to the first axis X1X1 of the first tunnel of the first piece 2 allows the surface of the water level 9 not to contact the ceiling wall of the first tunnel 2 or second tunnel 3*c*, and allows the upper chamber 3*a* of the second piece 3 not to be entirely filled with water.

It is understood that the inclination of the ceiling of the second tunnel and the radius of curvature R of the envelope surfaces of said first concave glide surface 20 and second convex surface 30 are such that it is possible to incline said first axis X1X1 by an angle α max of 5°, preferably 10°, relative to the horizontal, by rotating said second glide surface 30 relative to the first glide surface 20 of said angle α max, without the level of the water 9 passing through said first tunnel 2 and second tunnel 3*c* of said first piece touching the ceiling walls 211*a*, 211*b* and 321 of said tunnels, and without the upper chamber 3*a* of the cylindrical body of the second piece 3 being entirely filled with water.

Figure 6:
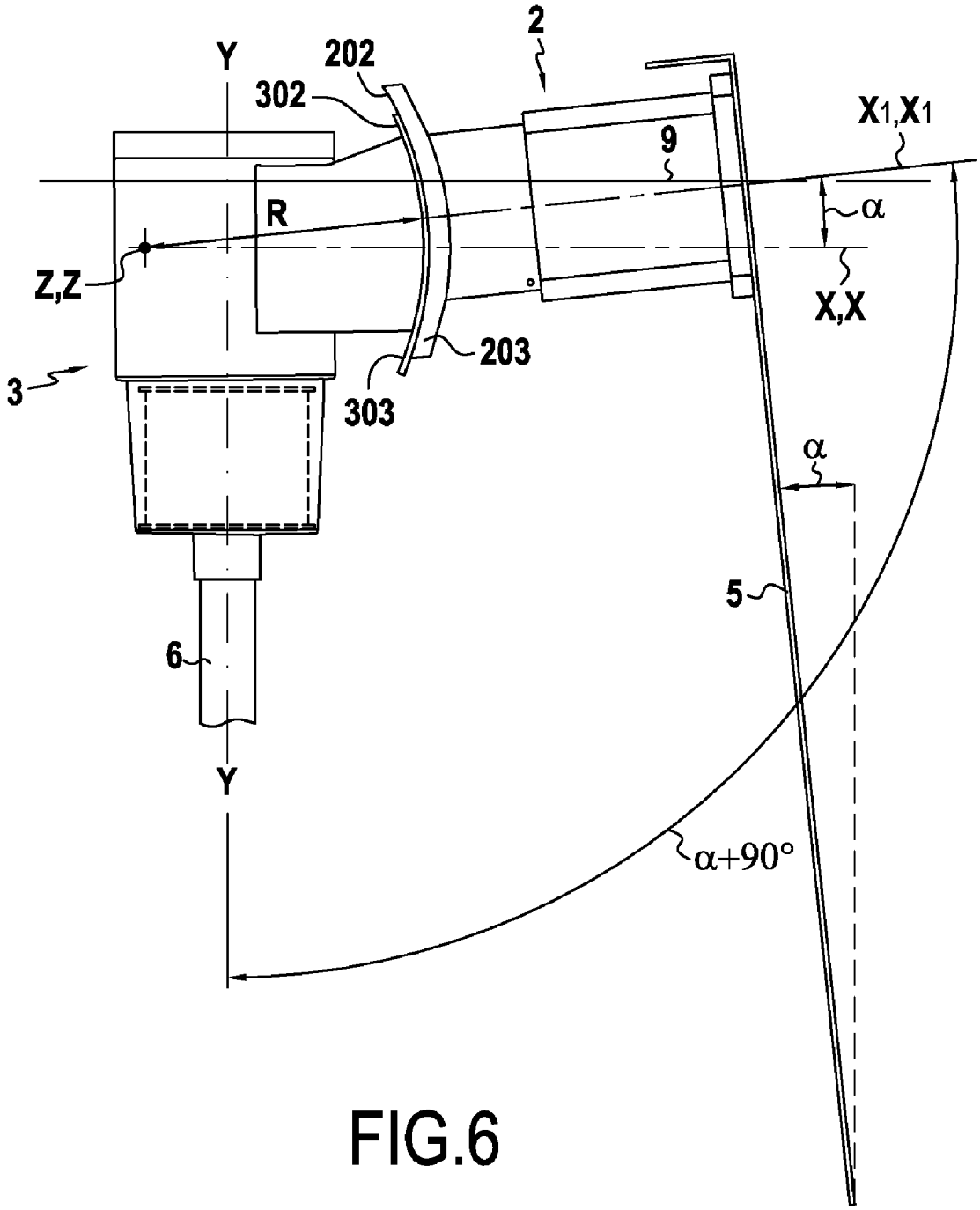
FIG. 6 illustrates the orientable skimmer according to the present invention, with maximal theoretical inclination of the skimmer body relative to said first piece.

FIG. 6 illustrates a skimmer oriented in α maximal theoretical position, corresponding here to around 5° α max, in which the end of the ceiling wall 321 of said second tunnel 3*c* just reaches the end of the ceiling wall 211*b* of the second part 2*b* delimiting the second opening 22 of the second tunnel 2. In this position, it is evident that the lower edge 303 of the second rim 300 projects over the lower edge 203 of the second rim 200, whereas the upper edge 202 of the first rim 200 projects over the upper edge 302 of the second rim 300. It is evident that in this maximal angular position, the level of the water 9 remains almost at mid height of the first opening 21 of the first tunnel 2, without touching the ceiling wall 321 of the second tunnel, nor completely filling the upper chamber 3*a* of the skimmer body. Varying the radius of curvature R and the length of the second tunnel 3*b* produces a different angle α max. In practice, rotation of an angle α max of around 5° is sufficient.

In general, the first piece 2 and second piece 3 are made of polymer material of type ABS, polypropylene, polyethylene or other thermoplastic polymers for transformation by injection or rotomoulding.

The invention claimed is:

1. A swimming pool skimmer, comprising:

a first piece forming a first guide tunnel of water of a swimming pool from a first longitudinal end opening terminating in a side wall of said swimming pool to a second longitudinal end opening terminating on a second piece above a filtration basket receptacle basket, said first piece having a first axis of symmetry in a longitudinal direction, and said second piece having a body with a cylindrical wall forming said basket of a first lateral orifice of said cylindrical wall communicating with said second opening of said first tunnel, and said cylindrical wall having a second axis of symmetry in a longitudinal direction, and said first piece and second piece being fixed to one another, orientably in several possible angular positions in which inclination, between said first axis and said second axis at a level of said first piece and said second piece, can vary from 90° to 90°+α max when said first axis, at the level of said first piece, has an inclination α relative to a horizontal varying from zero to an angle α max below the horizontal, said second axis being vertical.

2. The swimming pool skimmer according to claim 1, wherein said angle α max is less than or equal to 10.

3. The swimming pool skimmer according to claim 1, wherein said first piece comprises a first contact surface for cooperating with a second contact surface of a form complementary to said second piece, said complementary forms of said first contact surface and said second contact surface enabling circular rotation about a same axis of rotation perpendicular to said first axis and said second axis of two said first piece and said second piece relative to one another by displacement.

4. The swimming pool skimmer according to claim 3, wherein:

said first piece forms said first tunnel with a substantially rectangular transversal cross-section whereof side walls are flared coming together from said first opening of said first tunnel terminating in said side wall of the swimming pool, to said second opening of said first tunnel, said second opening of said first tunnel being edged by a first peripheral rim forming said first contact surface fitting in a cylindrical envelope surface, and said second piece comprises a substantially cylindrical wall of circular cross-section forming:

a cylindrical lower chamber for receiving said basket immediately after a lower orifice for communicating with a bottom of said lower chamber with a water discharge pipe in a water circulation circuit outside said swimming pool in a direction of a water treatment device, and a cylindrical upper chamber above the lower chamber, said cylindrical wall of said upper chamber having said first lateral orifice located above a receptacle zone of said basket, said first lateral orifice extending on one hand forming a second tunnel extending in a direction of a third axis perpendicular to said second axis, a second end opening of said second tunnel being edged by a second peripheral rim forming said second contact surface fitting in a cylindrical envelope surface of a same circular radius of curvature as said first rim, and at least side edges of said first peripheral rim and said second peripheral rim supporting at least partially on one another after fixing of said first piece and said second piece to one another in angular position.

5. The swimming pool skimmer according to claim 4, wherein said second tunnel comprises at least one ceiling wall inclined relative to said third axis when a base wall of said second tunnel is parallel to said third axis and in continuity of a base wall of said first tunnel and when said first axis and said third axis coincide, such that said second opening of said second tunnel of rectangular cross-section is greater than said second opening of said first tunnel, and such that, irrespective of said angular position in rotation relative to one another of said first contact surface and said second contact surface formed by said first rim and said second rim, said second opening of said first tunnel remains entirely included within limits of said second opening of said second tunnel.

6. The swimming pool skimmer according to claim 4, wherein:

said second rim comprises a plurality of perforations, said perforations being suitable for receiving screws, and said first rim comprises a plurality of fixing grooves, continuing and extending parallel in a direction in a plane perpendicular to said axis of rotation and parallel to said first axis, said fixing grooves being positioned vis-à-vis said perforations in all possible angular positions and said fixing grooves having width and depth to wedge ends of said screws once said screws are screwed through said perforations and said first piece and said second piece are fixed to one another.

7. The swimming pool skimmer according to claim 6, wherein said first rim and said second rim comprise said grooves and, respectively, said perforations on said side edges of said first rim and said second rim.

8. The swimming pool skimmer according to claim 7, wherein said fixing grooves and perforations are distributed evenly on said side edges, upper edges and lower edges of said first rim and said second rim.

9. The swimming pool skimmer according to claim 4, wherein at least one of said first rim and said second rim comprises a sealing groove over an entire circumference, near said edges of said second opening of said first tunnel or said second tunnel, said sealing groove being suitable for cooperating with a toric joint or suitable for receiving a bead of adhesive.

10. The swimming pool skimmer according to claim 9, wherein said adhesive is an elastomer.

11. The swimming pool skimmer according to claim 10, wherein said adhesive is a polyurethane type or a silicone type.

12. The swimming pool skimmer according to claim 4, wherein said water treatment device is a sand filter.

13. The swimming pool skimmer according to claim 1, wherein:

said first tunnel comprises a first part with side walls, vertical and flared, to a side of said first end opening of said first tunnel, and a second part with side walls, parallel and vertical to the side of said second end opening of said first tunnel, and said second tunnel comprises side walls, parallel and vertical in an extension of said side walls, vertical of said second part of said first tunnel.

14. A swimming pool comprising at least one side wall equipped with at least one skimmer according to claim 1.

15. The swimming pool according to claim 14, wherein said swimming pool has a shell made of stratified composite materials based on synthetic resin and fibres, and said skimmer is applied to said side wall of said shell inclined by an angle α less than or equal to α max, said first axis being substantially perpendicular to said side wall of said swimming pool.

16. The swimming pool according to claim 15, wherein said second axis is substantially vertical.

17. The swimming pool as claimed in claim 15, wherein said second axis is not substantially vertical and a upper chamber of a cylindrical body of said second piece is surmounted on a lifting device consisting of a tubular washer with a cylindrical wall whereof a lower end, which is adjusted about an upper end opening of said upper chamber of said second piece, is straight according to a transversal cross-section, an upper end of said washer having a cross-section according to a non-straight angle relative to said axis of said cylindrical wall of said washer such that by describing rotation on itself of said washer about said axis of said cylindrical wall said upper end of said washer is in a substantially horizontal plane.

18. The swimming pool skimmer according to claim 1, wherein said first piece comprises a first contact surface for cooperating with a second contact surface of a form complementary to said second piece, said complementary forms of said first contact surface and said second contact surface enabling circular rotation about a same axis of perpendicular to said first axis and said second axis of two said first piece and said second piece relative to one another by displacement by sliding relative to one another of said first contact surface and said second contact surfaces surface of said complementary forms.

* * * * *